United States Patent [19]

Lawton

[11] 4,150,174

[45] Apr. 17, 1979

[54] PRESSURE MARKING MATERIALS

[75] Inventor: William R. Lawton, Salem, N.H.

[73] Assignee: Dennison Manufacturing Company, Framingham, Mass.

[21] Appl. No.: 582,281

[22] Filed: May 30, 1975

[51] Int. Cl.[2] ..... B41M 3/12; B41M 5/00

[52] U.S. Cl. ..... 427/151; 427/153; 427/248 B; 427/276; 427/288; 428/307

[58] Field of Search ..... 427/146, 248, 151, 153, 427/288, 276; 428/537, 914, 307

[56] References Cited

U.S. PATENT DOCUMENTS

| | | | |
|---|---|---|---|
| 2,412,470 | 12/1946 | Norton | 427/248 |
| 3,110,386 | 11/1963 | Raines | 427/146 X |

OTHER PUBLICATIONS

Webster, 1966, p. 809.

*Primary Examiner*—Bernard D. Pianalto
*Attorney, Agent, or Firm*—Kenneth D. Hudson

[57] ABSTRACT

Improved pressure marking fibrous record material such as paper is provided wherein the rear surface is in contact with a profusion of liquid droplets of marking material such as ink. The fibers of the paper are vapor treated to render them repellent to the liquid marking material without substantially reducing the porosity of the sheet. Upon application of patterned marking pressure to the paper, the ink droplets are forced through the sheet to form a visible image of the pattern on the top surface. The repellent treatment reduces lateral flow of the ink in the sheet and improves image definition.

13 Claims, 15 Drawing Figures

PRESSURE MARKING MATERIALS

BACKGROUND OF THE INVENTION

This invention relates to pressure-sensitive record and transfer sheet material of the kind widely used in continuous and uni-set business forms, manifold books and credit transaction records. Visible records are formed in one or more copies by application of writing or printing pressure in the desired pattern with handwriting instruments, typewriters, embossed cards, printing plates, computer printers, or the like.

In making multiple copies of a record, transferable carbon has long been used both as individual sheets, either single use (one time carbon) or multiple use carbon papers, and as a permanent coating on the back of a record copy which transfers to an underlying sheet when writing pressure is applied. The original is often a ribbon copy.

Transferable pressure making record materials comprising coatings having a profusion of discrete liquid droplets of marking material dispersed in a pressure rupturable matrix are known and are disclosed for example in U.S. Pat. Nos. 2,374,862; 2,299,693; and 2,299,694. As disclosed therein, a wide variety of matrix materials and liquid droplets can be used. Dyes, pigments or mixtures thereof can be dissolved or dispersed in a carrier liquid, generally of relatively low viscosity and which can be either volatile or non-volatile, and the resulting dispersion emulsified into small droplets in a matrix of film forming material for coating. Also, mixtures of two color forming co-reactants separated prior to application of marking pressure can be employed. Encapsulated droplets can be formed by coacervation as disclosed for example in U.S. Pat. No. 2,800,457.

In U.S. Pat. No. 3,020,171 issued Feb. 6, 1962, a marking system is disclosed wherein the record marks are formed by rupturing liquid droplets of marking material and allowing the liquid to flow through the sheet to form a visible mark on the side opposite the coating. Such systems have the potential to mark two sheets at once, the top surfaces of the sheets below and above the droplets, thereby reducing the number of coatings required. So far as is known, however, the system has not been used commercially to any significant extent. This is believed to be due to lateral as well as vertical movement of the liquid marking material through the sheet producing a blurred image with loss of definition.

OBJECTS OF THE INVENTION

It is the primary object of the present invention to provide an improvement in the procedure such as shown in U.S. Pat. No. 3,020,171 wherein an image or mark is formed on the front face of a record sheet by flow of an ink material from the back through the thickness of the sheet. In particular, this invention provides an improvement whereby there is less lateral movement of the ink in passing through the sheet and better definition of the resulting mark is obtained.

Further objects of the present invention include provision of business forms or form-sets for the making of a plurality of copies which are lower in cost and waste because of the fewer number of coatings or transfer sheets required; provision of credit card forms which permit formation of an image on the front face of an opaque white top copy when printed from an embossed card; provision of images or marks which extend through the sheet and are not readily altered; provision of form-sets which permit the marking of a greater number of copies from a given printing pressure because of the fewer sheets and coatings required; and provision of form-sets which are less readily marked in handling.

SUMMARY OF THE INVENTION

It has now been discovered that marks or images of improved sharpness and definition can be provided on the face of a fibrous record material such as paper having pores extending therethrough, by flowing ink or other liquid marking material from the rear face to the front face of the sheet, if the fibers of the record member are treated to make them repellant to the marking liquid without substantially reducing the porosity of the sheet. Repellant as used herein means that the fibers which define the walls of the pores and the surfaces of the sheet are so treated that the liquid droplets, in the absence of pressure, either remain on the surface without penetrating or being absorbed within the sheet in a manner similar to the action of water on a waxy or greasy surface, or their rate and extent of lateral movement is retarded. Thus the materials deposited on the fiber are incompatible with the liquid marking droplet such that the wetting of the fibers thereby is retarded. It is theorized that printing pressure applied in an essentially vertical direction through the thickness of the sheet in effect opens the pores to the liquid and allows or forces it to flow through the sheet in the direction of pressure application and with reduced lateral movement. Where the fiber treatment renders the paper water-repellant, further cost reductions can be obtained by utilizing water based coatings to apply the marking liquid.

A number of repellent treatments for paper and the like are known. However, for the present invention, it is important that the porosity of the fibrous sheet not be substantially reduced, as measured for example by its gas or vapor transmission. For this reason liquid sizing or resinous treatments which produce significant reduction in porosity are not suitable. Thus QUILON, a liquid DuPont material believed to be a Werner-type chromium complex, in the amounts commonly employed to make paper water-repellant, is not suitable.

For the purpose of the present invention, it is preferred that the repellency be obtained by a vapor phase treatment of the fibers and that the amount of the residue so applied be small, preferably below about 2% of the weight of the untreated sheet, and more preferably below 1%. Several vapor treatments are known, for example, treatment of paper with isocyanate vapors, and, according to U.S. Pat. No. 3,017,290, treatment with esters of alpha-cyanoacrylic acid. The treatment selected should be one providing repellency to the liquid marking materials employed.

The most effective and preferred vapor treatment for the present invention is the treatment of fibrous sheet material, especially cellulosic fibers, with organo silicon halide vapors, also known as organo-halogeno-silanes. They provide highly effective water repellency and retard lateral spread of oils with small additions and at relatively low cost. Such processes are described in a number of patents, for example, U.S. Pat. Nos. 2,306,222 (1942); 2,336,259 (1945); 2,412,470 (1946); and 3,856,558 (1975). As is well known, care must be employed to avoid undue fiber degradation from the hydrogen chloride generated as a result of the treatment reaction. So applied, such treatment does not affect the esthetic characteristics of the sheet and the amounts added are so small that they are difficult to detect. Vapor transmission is essentially unimpaired. Excess residue, sufficient to produce significant reduction in porosity, is unnecessary and easily avoided. Improved treatment is described in U.S. Patent Application Ser. No. 566,220, filed Apr. 9, 1975, incorporated herein by reference.

The commonly available silanes are lower alkyl silicon chlorides, including methyl-dichlorosilane, dimethyl dichlorosilane, and methyl-trichlorosilane. Mixtures are normally employed although single compounds, preferably dimethyl-dichlorosilane, can be used alone. Di- and tri-halogen silanes are preferred. One suitable mixture comprises 65% by weight methyl trichlorosilane, 20% dimethyl dichlorosilane, and 15% methyl dichlorosilane, as described in the prior art. A treating rate of 2% silane, based on the weight of the paper treated is suitable; less than one-half that amount, estimated to be in the range of 0.2 to 0.5%, being added to the paper as reaction residue. Siloxanes are thought to result from reaction with moisture and hydroxyl groups. The residue with cellulose cannot be fully extracted with solvent and is thought to be bound through the cellulose hydroxyl groups. Methyl is the preferred organic group because of relatively low cost and high volatility.

DETAILED DESCRIPTION OF THE INVENTION

In the drawings wherein all views are in cross-section:

Figure 1:
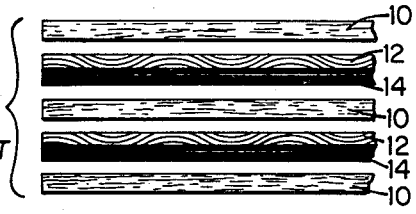
Fig. 1. PRIOR ART
FIG. 1 illustrates a conventional three copy form-set of the prior art using one time carbon throw-away sheets for making the second and third copies.
Figure 10:
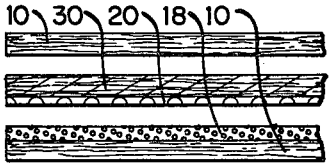
FIG. 10 illustrates a three copy form-set according to this invention wherein the third copy has on its front face a coating of colorless liquid droplets of dye forming material and the rear face of the second copy is coated a liquid coreactant.
Figure 12:
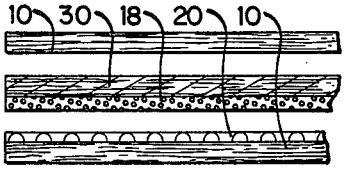
FIG. 12 illustrates a three copy form-set according to this invention in which the coatings described in FIG. 10 are reversed.
Figure 13:
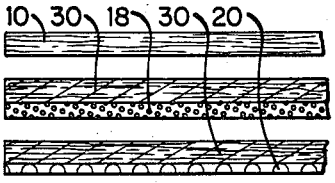
FIG. 13 is a figure similar to FIG. 11 in which the coatings are reversed.

Referring to the drawings, FIGS. 1–5 illustrate prior art form-set business forms for making three copies of a record, an original and two duplicates. In these FIGS. 10 designates ordinary printing bond paper with or without coatings, while 12 is a sheet of throw-away tissue coated with a layer of transferable carbon 14. Tissue 12 and carbon coating 14 comprise together a sheet of carbon paper, commonly used in business forms once and discarded. In FIG. 1 two sheets of such carbon paper are interleaved with three bond sheets 10 to make up a common business form for the making of three copies. Additional copies can be made by adding additional bond sheets with interleaving carbon sheets but a limit is soon reached where additional copies are insufficiently legible due to attentuation of the pressure applied. In each of FIGS. 1–5, the top sheet shown is a ribbon copy.

Figure 2:
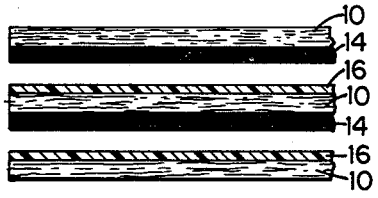
Fig. 2. PRIOR ART
FIG. 2 illustrates a three copy prior art business form-set in which the transfer carbon is provided as a coating on the rear face of the first and second copies, and in which the second and third copies have a receptor coating on their front faces.

FIG. 2 differs from FIG. 1 in that carbon layers 14 are applied to the rear faces of the first and second bond sheets 10 and no disposable tissue sheets 12 are used. The carbon layers 14 remain on the record copies. The front surfaces of the second and third sheets are coated with a thin layer of receptor material such as polyethylene 16 for reception of carbon transferred under printing pressure from layers 14.

Figure 3:
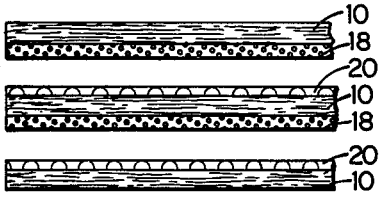
Fig. 3. PRIOR ART
FIG. 3 illustrates a prior art form-set for making an original and two copies in which rupturable colorless dye capsules are coated on the rear faces on the first and second copies and a receptor co-reactant is coated on the front faces of the second and third copies.

FIG. 3 illustrates a prior art carbon less three copy form-set wherein colorless color forming liquid droplets such as leuco dyes dispersed in a pressure rupturable matrix are coated on the back faces of the first and second copies. A layer 20 of a co-reactant material such as an acid clay is coated on the front faces of the second and third copies which reacts with the released leuco dye to form a contrasting colored mark. Materials suitable for such use are disclosed in the aforementioned prior art patents, U.S. Pat. Nos. 2,800,457; 2,800,458 and 3,020,171, and the disclosures of these patents are incorporated herein by reference.

Figure 4:
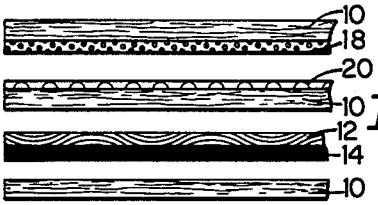
Fig. 4. PRIOR ART
FIG. 4 illustrates a prior art form-set for making three copies in which the second copy is formed by reaction similar to FIG. 3, while the third copy is a carbon transfer copy suitable for electronic scanning.
Figure 5:
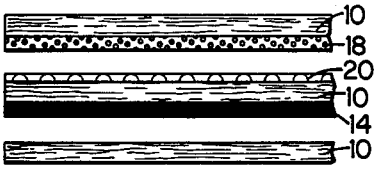
Fig. 5. PRIOR ART
FIG. 5 illustrates a prior art form-set similar to FIG. 4 wherein the carbon transfer coating is provided on the rear face of the second copy.
Figure 14:
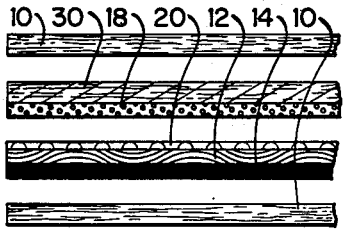
FIG. 14 illustrates a form-set of this invention for making three copies in which a disposable transfer sheet is used between the second and third copies, the third copy being an electronically scannable carbon copy.
Figure 15:
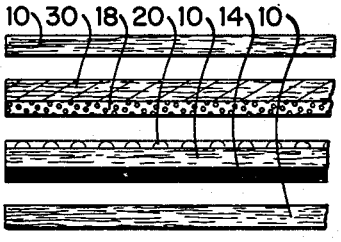
FIG. 15 is a view similar to FIG. 14 but in which the third sheet is used to provide an extra copy.

FIGS. 4 and 5 illustrate modifications of the prior art structures described above in which the first copy is a ribbon copy 10 coated on the rear face with a layer of capsules 18, and the second copy coated with a layer co-reactant 20 on its front face to form an image in a manner similar to that shown in FIG. 3. The last copy in each Figure however is formed by carbon transfer from carbon layer 14, from the rear face of the throw-away tissue sheet 12 in FIG. 4 and from the rear face of the second copy sheet in FIG. 5, to provide a carbon image which is more readily scanned by electronic means.

Figure 6:
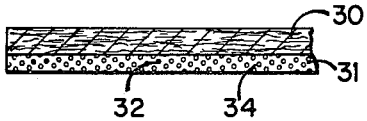
FIG. 6 is a single pressure marking record sheet according to the present invention.

FIG. 6 illustrates a novel record member according to the present invention comprising a fibrous sheet 30 such as bond paper coated on its rear face from a dye emulsion as illustrated hereinafter and as shown in U.S. Pat. No. 2,374,862. The fibers are rendered repellent with silane residue. The emulsion coating 31 comprises liquid droplets 32 of marking material dispersed in a pressure rupturable matrix 34. The remaining FIGS. 7–15 illustrate various multiple copy form-sets in which the treated record member 30 can be used and, when compared with the prior art of FIGS. 1–5, illustrate savings in material and cost.

Figure 9:
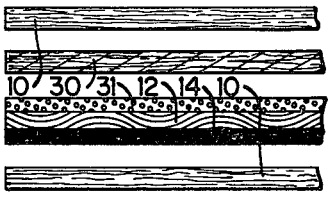
FIG. 9 illustrates a form-set according to this invention for making three copies using a transfer sheet between the second and third copies.
Figure 11:
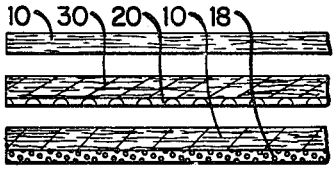
FIG. 11 is a view similar to FIG. 10 in which the colorless liquid droplets are coated on the rear face of the third copy.

Record sheet 30 comprises any suitable fibrous record sheet, preferably paper, having pores defined by the interstices between the fibers which extend both laterally and vertically through the sheet from the back to the front face, coated with the residue of a vapor phase treatment to render the fibers repellent without substantially reducing the porosity. The fibrous material employed should have a relatively open or porous structure with a minimum of sizing. Bond paper in a basis weight between about 9 to 40 pounds per ream (3000 square feet), not supercalendered, is preferred. Treated record sheet 30 is contacted on its rear face with a profusion of liquid droplets of marking material either by coating (FIG. 6) or interleaving with another sheet containing such coating (FIG. 9).

The liquid droplets of marking material can comprise any suitable material. Extensive examples are disclosed in the aforementioned prior art patents. For reasons of cost, emulsions of dyes and/or pigments dispersed in a chemically inert liquid carrier capable of penetrating the paper under marking pressure are preferred. Such carrier liquids may be volatile or non-volatile as desired. The dye and carrier liquid can be emulsified in a continuous phase of a pressure-rupturable film-forming material such as polyvinyl alcohol or the like.

As the preferred example of the present invention, an open bond paper, 4% moisture content by weight, was exposed to the foregoing 65%–20%–15% weight mixture of methyl-polychloro-silanes, 2% total silanes based on the weight of paper treated, for from 1 to 5 seconds, and the paper post-heated at 300° F. The so-treated paper was highly water and oil repellant. The silane treated paper was then coated with the following emulsion.

A. Inner or Dispersed Phase

AMAPLAST BLACK HY (dye): 120 parts by weight
Dresinate XX: 20 parts
soya bean oil: 1860 parts B. Outer or Continuous Phase Elvanol 52-22 G: 240 parts
Water: 2760 parts The materials in the inner phase were heated with stirring to a temperature of 300° F. for three hours. The hot inner phase was added slowly with high speed stirring to the outer phase solution of polyvinyl alcohol in water. The resulting emulsion was applied to the paper with a three-roll coating head including an applicator and doctor roll. The coating was then smoothed with a number 10 Meyer rod and dried at 325° F. Samples with coating weights between 2.7 and 8.1 pounds per three thousand square feet were applied. Weights between or about 5 to 7 pounds are preferred.

The above water based coating was applied with good tension control and handling technique to water-repellant paper to minimize disruption of the paper structure by the water. If desired, non-aqueous coating emulsions can be substituted.

Figure 7:
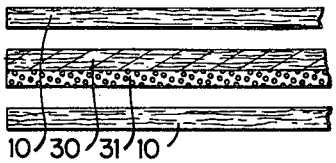
FIG. 7 illustrates a form-set according to this invention suitable for making three copies in which the second sheet in according to FIG. 6.
Figure 8:
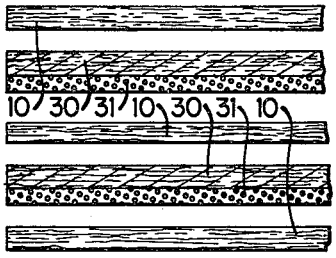
FIG. 8 is a view similar to FIG. 7 illustrating a five copy form-set according to this invention having but two coatings of liquid droplets of marking material.

The resulting treated and coated paper 30, 31 is shown in FIGS. 6–8 wherein liquid droplets of inner phase 32 are dispersed in a solid continuous matrix 34 of polyvinyl alcohol. On application of printing pressure in a pattern, the matrix 34 is ruptured and the liquid droplets of marking material are freed and penetrate upwardly through the sheet with good definition. They also transfer simultaneously to an underlying sheet as shown in FIGS. 7 and 8. The underlying sheet receiving marking material directly on its front face does not require repellency treatment and can consist of ordinary bond paper, if desired.

Other liquid carriers for the dye in the inner phase which can be used include Arneel OD, Arneel T, Arneel S, Arneel TD, Arneel 12-D, butylcellosolve laurate, methylcellosolve oleate, n-butyl myristate, n-butyl palmitate, n-butyl laurate, oleyl alcohol, Santicizer 214, Santicizer B-16, Flexo-4GO, Flexo 3GO, Glexo 1 Plasticizer EP-8, dimethyl phthalate, tri-n-butyrin, and those described in the prior art. Other dyes and finely divided pigments such as carbon black, may also be used. The carrier liquid selected should be repelled or incompatible with the treating residue on the fibers of the record material. For use with silane repellency treatments, liquid carriers having some polarity are preferred. Dye solutions are also preferred.

In addition to emulsion coatings, any of the known marking liquids which involve reactions of two or more co-reactants to form a color, such as leuco dye systems disclosed in the aforementioned patents, can be used. The other co-reactant, for example an acidic material, can be applied to the surface where the visible mark is desired. Acid clay coatings can be used. Preferably, the acidic co-reactants are dispersed in liquid carrier droplets where they are free to migrate through a treated record member as shown for example in FIGS. 11 and 13. The liquid droplets of either co-reactant may be microencapsulated, if desired, for example by coacervation.

Comparison of form-sets of this invention illustrated in FIGS. 7–15 with the prior art of FIGS. 1–5 illustrate the fewer number of coatings and disposable transfer sheets required. Since the marks made through the back of the treated sheets extend therethrough, they cannot readily be altered. And where co-reactants separated by treated sheets are employed, as in FIGS. 11 and 13, the form-sets are not as readily marked in handling, for example by the pressure imposed by slitting knives. With fewer coatings or transfer sheets, a greater number of record copies can be made.

It should be understood that the foregoing description is for the purpose of illustration and that the invention includes all modifications and equivalents within the scope of the appended claims.

What is claimed is:

1. In a pressure marking record material comprising a fibrous sheet having pores extending therethrough, the back surface of the sheet being in contact with a profusion of liquid droplets of marking material adapted on application of marking pressure in a pattern to form a visible mark according to said pattern through and onto the front surface of said sheet, the improvement wherein the fibers of said sheet are coated with the residue of a vapor treatment rendering them repellent to said liquid marking material without substantially reducing the porosity of said sheet, whereby lateral movement of liquid marking material in passing through the sheet in response to marking pressure is reduced, and the definition of the visible mark on the front face of the sheet is enhanced.

2. Pressure marking record material according to claim 1 wherein said fibrous sheet is paper.

3. Pressure marking record material according to claim 2 wherein said profusion of liquid droplets of marking material are dispersed in a pressure-rupturable matrix as a coating on the rear surface of said sheet.

4. Pressure marking material according to claim 2 wherein said residue constitutes less than about 2% of the weight of said paper.

5. Pressure marking record material according to claim 4 wherein said residue is formed from vapors of one or more organo-silicon halide.

6. Pressure marking record material according to claim 5 wherein said silicone halide is a polymerizable lower alkyl silicone halide.

7. Pressure marking record material according to claim 6 wherein said silicone halide comprises dichloro-dimethyl silane or trichloro-methyl silane.

8. A pressure-marking form-set comprising a plurality of record sheets at least one of which is a repellant sheet according to claim 1.

9. A pressure-marking form-set comprising a plurality of record sheets at least one of which is a coated sheet according to claim 5.

10. A pressure-marking record material according to claim 5 wherein said liquid material comprises a profusion of droplets of dye in a liquid carrier, said droplets being dispersed in a pressure-rupturable matrix.

11. A form-set according to claim 7 wherein said liquid droplets of marking material comprises a colorless dye component in a carrier liquid, the droplets being dispersed in a pressure-rupturable matrix, one of the sheets in said set containing a coating of color-forming co-reactant for said dye.

12. A pressure marking form-set for making at least two record copies which comprises in combination two superposed sheets of fibrous paper, the uppermost sheet having its fibers coated with the residue of a vapor treatment with one or more organo-silicon halides, said residue comprising less than about 2% by weight of said paper, and between said sheets a layer of marking material comprising a profusion of liquid droplets adapted to be released on application of marking pressure, said residue being repellant to said liquid droplets and reducing lateral movement thereof in passing through the overlying sheet in response to marking pressure.

13. The method of marking the front surfaces of at least two record sheets which comprises the steps of providing two superposed sheets of paper with a profusion of liquid droplets of marking material therebetween, the uppermost sheet being porous and having fibers which are coated with the residue of a vapor treatment with one or more organo-silicon halides, said residue being repellant to said liquid droplets and constituting less that about two (2) percent of the weight of said paper, and applying marking pressure to said sheets in a pattern to form a visible mark in accordance with said pattern on the upper surfaces of both sheets, the liquid droplets migrating under said pressure through the said uppermost sheet with lateral movement thereof reduced by said repellant residue.

* * * * *